US007932807B2

(12) United States Patent
Sato et al.

(10) Patent No.: US 7,932,807 B2
(45) Date of Patent: Apr. 26, 2011

(54) VARISTOR

(75) Inventors: Hiroyuki Sato, Tokyo (JP); Makoto Numata, Tokyo (JP); Yo Saito, Tokyo (JP); Hitoshi Tanaka, Tokyo (JP); Goro Takeuchi, Tokyo (JP); Osamu Taguchi, Tokyo (JP); Ryuichi Tanaka, Tokyo (JP)

(73) Assignee: TDK Corporation, Tokyo (JP)

( * ) Notice: Subject to any disclaimer, the term of this patent is extended or adjusted under 35 U.S.C. 154(b) by 296 days.

(21) Appl. No.: 12/396,942

(22) Filed: Mar. 3, 2009

(65) Prior Publication Data

US 2009/0243768 A1 Oct. 1, 2009

(30) Foreign Application Priority Data

Mar. 28, 2008 (JP) ..... 2008-086982

(51) Int. Cl.
*H01C 7/10* (2006.01)

(52) U.S. Cl. ..... 338/21; 338/20

(58) Field of Classification Search ..... 338/20–21, 338/22 R, 25

See application file for complete search history.

(56) References Cited

U.S. PATENT DOCUMENTS

| | | | | |
|---|---|---|---|---|
| 3,768,058 | A * | 10/1973 | Harnden, Jr. | 338/20 |
| 4,400,683 | A * | 8/1983 | Eda et al. | 338/21 |
| 5,412,357 | A * | 5/1995 | Nakamura et al. | 333/181 |
| 5,870,273 | A * | 2/1999 | Sogabe et al. | 361/306.3 |
| 6,507,268 | B2 * | 1/2003 | McLoughlin | 338/21 |
| 7,279,724 | B2 * | 10/2007 | Collins et al. | 257/103 |
| 2006/0061449 | A1 | 3/2006 | Kazama | |
| 2007/0200133 | A1 | 8/2007 | Hashimoto et al. | |

FOREIGN PATENT DOCUMENTS

| | | |
|---|---|---|
| EP | 1 580 809 A2 | 9/2005 |
| JP | A-2002-100826 | 4/2002 |
| JP | A-2002-246207 | 8/2002 |
| JP | A-2002-252136 | 9/2002 |
| JP | A-2006-86274 | 3/2006 |
| JP | A-2006-287020 | 10/2006 |

* cited by examiner

*Primary Examiner* — Kyung Lee
(74) *Attorney, Agent, or Firm* — Oliff & Berridge, PLC

(57) ABSTRACT

A first varistor section includes a first face of an element body, and a third face facing the first face. The first varistor section has a first varistor element body, a first varistor electrode electrically connected to a first external electrode, and a second varistor electrode electrically connected to a second external electrode. A heat radiation section has a first heat radiation portion kept in contact with the third face of the first varistor section and electrically connected to the first and third external electrodes, a second heat radiation portion kept in contact with the third face of the first varistor section and electrically connected to the second and fourth external electrodes, and an insulating layer located between the first heat radiation portion and the second heat radiation portion and electrically insulating the first heat radiation portion and the second heat radiation portion from each other. The first heat radiation portion and the second heat radiation portion contain a metal.

7 Claims, 7 Drawing Sheets

(a)

(b)

VARISTOR

BACKGROUND OF THE INVENTION

1. Field of the Invention

The present invention relates to a varistor.

2. Related Background Art

There is a varistor having a varistor element body of a nearly rectangular parallelepiped shape to exhibit the nonlinear voltage-current characteristics, a pair of varistor electrodes facing each other with a part of the varistor element body in between, and a pair of external electrodes formed on the exterior surface of the varistor element body and connected to the respective corresponding varistor electrodes (e.g., cf. Japanese Patent Application Laid-open No. 2002-246207).

SUMMARY OF THE INVENTION

A varistor is connected in parallel to an electronic device such as a semiconductor light-emitting device or FET (Field Effect Transistor), thereby to protect the electronic element from ESD (Electrostatic Discharge). Some of such electronic devices generate heat during operation. If the electronic device becomes hot, it will undergo degradation of characteristics of its own to affect the operation thereof. Therefore, it is necessary to efficiently radiate the generated heat.

An object of the present invention is therefore to provide a varistor capable of efficiently radiating heat.

The present invention provides a varistor comprising: an element body having a first face and a second face facing each other; first and second external electrodes arranged on the first face of the element body; and third and fourth external electrodes arranged on the second face of the element body, wherein the element body has: a first varistor section including the first face, and a third face facing the first face; and a heat radiation section in contact with the third face of the first varistor section, wherein the first varistor section has: a first varistor element body to exhibit the nonlinear voltage-current characteristics; a first varistor electrode at least a part of which is in contact with the first varistor element body and which is electrically connected to the first external electrode; and a second varistor electrode at least a part of which is in contact with the first varistor element body and which is electrically connected to the second external electrode, and wherein the heat radiation section has: a first heat radiation portion in contact with the third face of the first varistor section, the first heat radiation portion containing a metal and electrically connected to the first and third external electrodes; a second heat radiation portion in contact with the third face of the first varistor section, the second heat radiation portion containing a metal and electrically connected to the second and fourth external electrodes; and an insulating layer located between the first heat radiation portion and the second heat radiation portion and electrically insulating the first heat radiation portion and the second heat radiation portion from each other.

In the varistor of the present invention, the first and second external electrodes are arranged on the first face, the third and fourth external electrodes are arranged on the second face, the first heat radiation portion in contact with the varistor section electrically connects the first external electrode and the third external electrode, and the second heat radiation portion in contact with the varistor section electrically connects the second external electrode and the fourth external electrode. This configuration permits the varistor to be mounted on a substrate by flip chip mounting in such a manner that a pair of external electrodes on either one of the first face and the second face are connected to an electronic device and that the other pair of external electrodes on the other face are connected to lands on the substrate.

In the varistor of the present invention, the first and second heat radiation portions efficiently radiate heat of the electronic device connected to the varistor. Consequently, the first heat radiation portion has two functions, the function to electrically connect the first external electrode and the third external electrode and the heat radiation function, and the second heat radiation portion has two functions, the function to electrically connect the second external electrode and the fourth external electrode and the heat radiation function, which relatively simply realizes the configuration capable of efficiently radiating heat. Therefore, the varistor of the present invention is also relatively easy to manufacture.

Preferably, the element body further has a second varistor section including the second face, and a fourth face facing the second face; in each of the first and second heat radiation portions, a face facing a face in contact with the third face of the first varistor section is in contact with the fourth face of the second varistor section; the second varistor section has: a second varistor element body to exhibit the nonlinear voltage-current characteristics; a third varistor electrode at least a part of which is in contact with the second varistor element body and which is electrically connected to the third external electrode; and a fourth varistor electrode at least a part of which is in contact with the second varistor element body and which is electrically connected to the fourth external electrode. In this case, the varistor has the first and second varistor sections connected in parallel to each other with the heat radiation section in between. This configuration permits the varistor to fulfill the varistor function better.

Preferably, in the first heat radiation portion a face facing a face in contact with the third face of the first varistor section comprises the second face and is physically and electrically connected to the third external electrode; in the second heat radiation portion a face facing a face in contact with the third face of the first varistor section comprises the second face and is physically and electrically connected to the fourth external electrode.

Preferably, the heat radiation section further includes a side face parallel to a direction in which the first face and the second face face each other; the side face is covered by an insulator. In this case, when the varistor of the present invention is mounted on a substrate, electrical insulation is certainly achieved from surrounding parts.

Preferably, the first varistor element body contains ZnO as a major component; the first and second heat radiation portions are comprised of a composite material of a metal and a metal oxide. Furthermore, preferably, the second varistor element body also contains ZnO as a major component. In these cases, since the first and second heat radiation portions contain the metal oxide as the varistor element body does, the joint strength between the varistor element body and the first and second heat radiation portions is ensured in the structure in which the varistor element body is in physical contact with the first and second heat radiation portions.

Preferably, the insulating layer of the heat radiation section is made of a ceramic material. In this case, when the varistor is manufactured, the insulating layer of the heat radiation section can be fired simultaneously with the first varistor section and the first and second heat radiation portions.

The varistor of the present invention is able to efficiently radiate heat. The varistor of the present invention can be mounted on a substrate by flip chip mounting.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The best mode for carrying out the present invention will be described below in detail with reference to the accompanying drawings. In the description of the drawings the same elements will be denoted by the same reference symbols, without redundant description.

Figure 1:
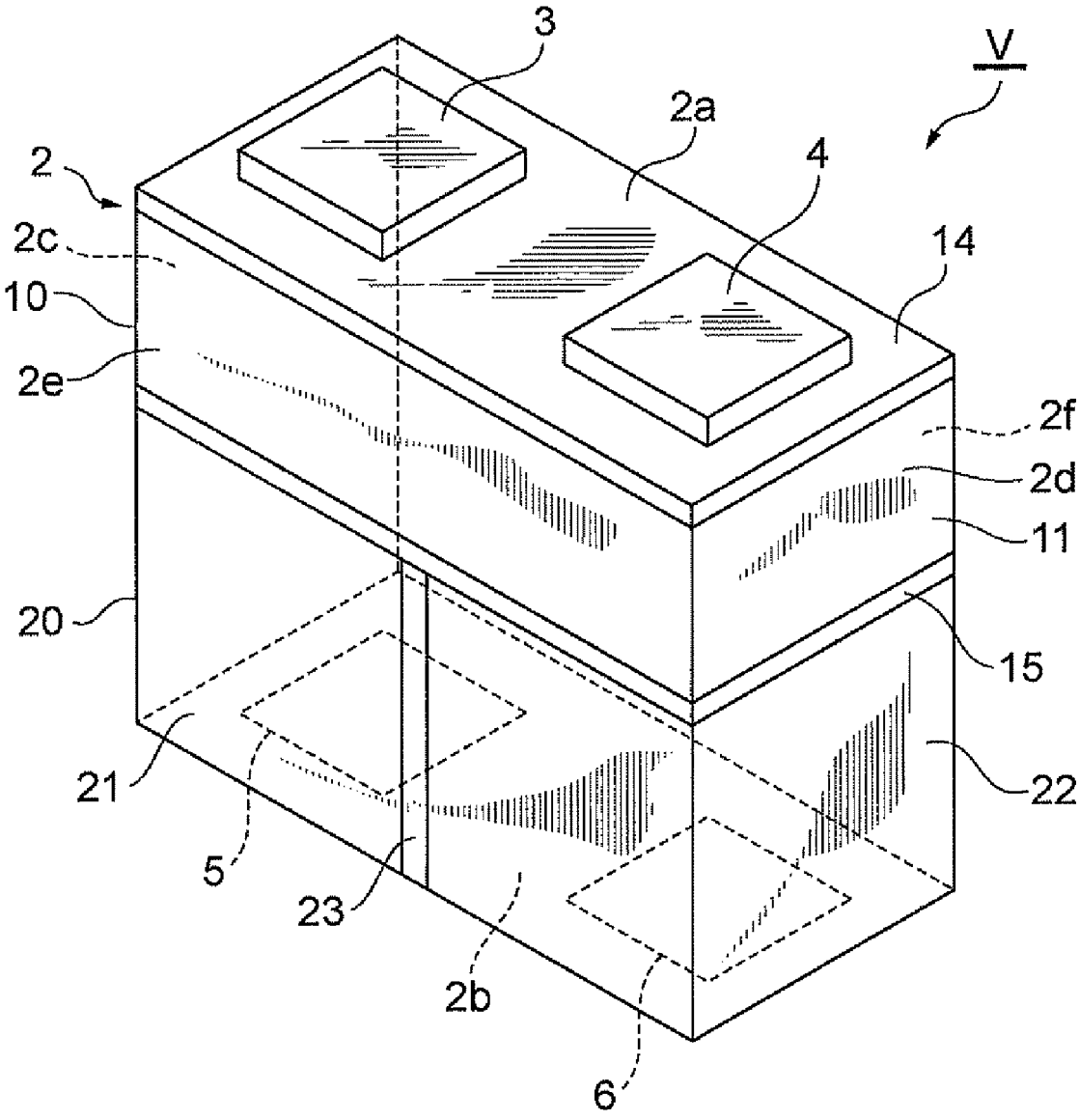
FIG. 1 is a schematic perspective view showing a varistor according to an embodiment of the present invention.
Figure 2:
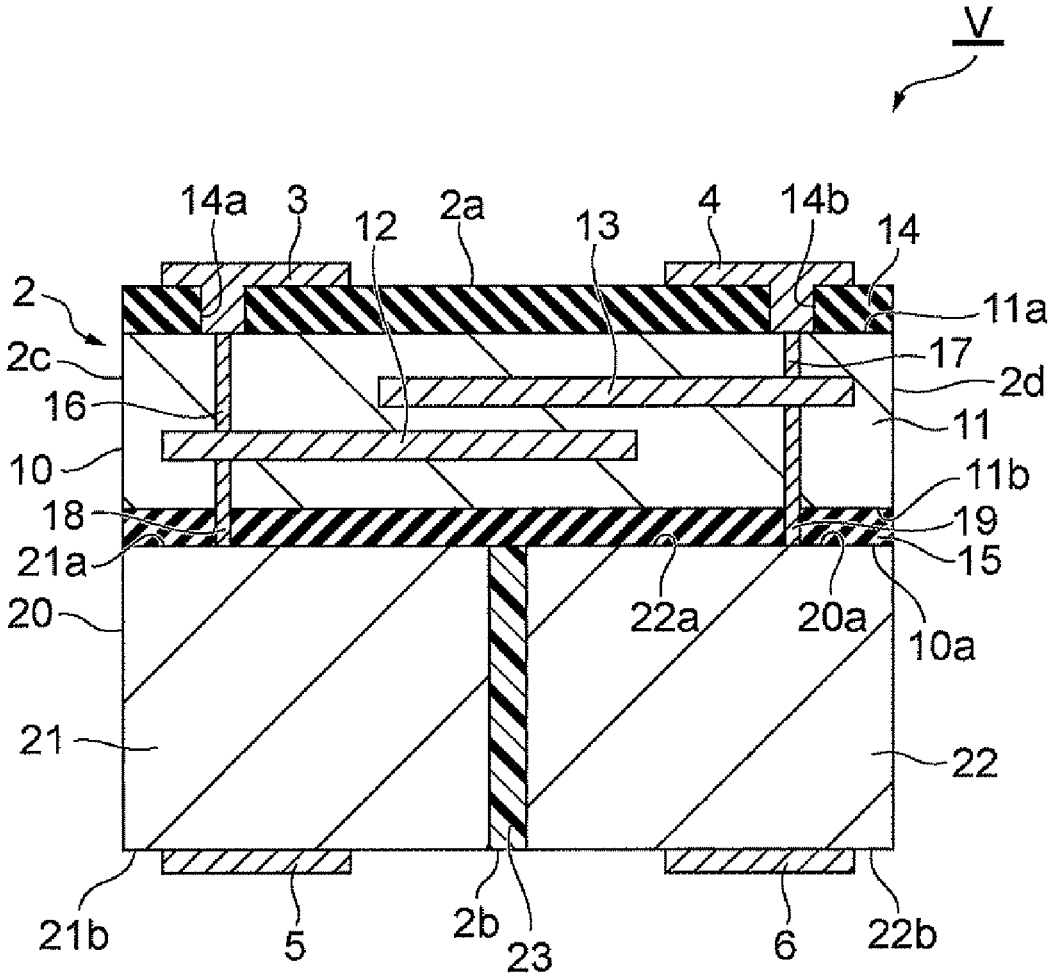
FIG. 2 is a schematic sectional view showing the varistor according to the embodiment.

FIG. 1 is a schematic perspective view of a varistor according to an embodiment of the present invention. FIG. 2 is a schematic sectional view of the varistor according to the embodiment. As shown in FIGS. 1 and 2, the varistor V of the present embodiment has an element body 2 of a nearly rectangular parallelepiped shape, and first to fourth external electrodes 3, 4, 5, and 6 arranged on the element body 2.

The element body 2 has a first face 2*a* and a second face 2*b* facing each other, and four side faces 2*c*-2*f* perpendicular to the first and second faces 2*a*, 2*b*. First and second external electrodes 3 and 4 are arranged on the first face 2*a* of the element body 2. The first external electrode 3 and the second external electrode 4 each are formed in a nearly rectangular shape and are arranged away from each other so that one side thereof is parallel to one side of the first face 2*a*. Third and fourth external electrodes 5 and 6 are arranged on the second face 2*b* of the element body 2. The third external electrode 5 and the fourth external electrode 6 each are formed in a rectangular shape and are arranged away from each other so that one side thereof is parallel to one side of the second face 2*b*.

The element body 2 has a varistor section 10 located on the first face 2*a* side, and a heat radiation section 20 located on the second face 2*b* side. The varistor section 10 is of a nearly rectangular parallelepiped shape and includes the first face 2*a*, and a third face 10*a* facing the first face 2*a*. The heat radiation section 20 is of a nearly rectangular parallelepiped shape and includes the second face 2*b*, and a face 20*a* facing the second face 2*b*. The third face 10*a* of the varistor section 10 is in contact with the face 20*a* of the heat radiation section 20.

The varistor section 10 has a varistor element body 11 of a nearly rectangular parallelepiped shape, a first varistor electrode 12 and a second varistor electrode 13 arranged inside this varistor element body 11, and two insulating layers 14, 15. The insulating layer 14 and the insulating layer 15 are arranged so as to sandwich the varistor element body 11 in a direction in which the first face 2*a* and the second face 2*b* face each other (which will be referred to hereinafter as "facing direction").

The varistor element body 11 has a face 11*a* in contact with the insulating layer 14 and a face 11*b* in contact with the insulating layer 15. The face 11*a* and the face 11*b* face each other in the aforementioned facing direction. The four side faces of the varistor element body 11 constitute certain areas of the four side faces 2*c*-2*f* of the element body 2, i.e., portions of the four side faces 2*c*-2*f* near the first face 2*a*. The varistor element body 11 is made of a semiconductor ceramic material to exhibit the nonlinear voltage-current characteristics and, specifically, it contains ZnO as a major component and Pr, Bi, etc. as minor components. These minor components exist in the form of simple metal or oxide in the varistor element body 11.

The first varistor electrode 12 and the second varistor electrode 13 are formed in a nearly rectangular shape and are arranged so as to face each other in the facing direction as electrically insulated from each other. The first varistor electrode 12 is arranged nearer to the side face 2*c* and to the third face 10*a* than the second varistor electrode 13.

The varistor section 10 has a through-hole electrode 16 and a through-hole electrode 17. The through-hole electrode 16 is physically and electrically connected to the first varistor electrode 12 and penetrates the varistor element body 11 between the face 11*a* and the face 11*b* thereof. The through-hole electrode 17 is physically and electrically connected to the second varistor electrode 13 and penetrates the varistor element body 11 between the face 11*a* and the face 11*b* thereof. One end of each through-hole electrode 16, 17 is exposed in the face 11*a* and the other end is exposed in the face 11*b*.

The insulating layer 14 is in contact with the face 11*a* of the varistor element body 11 and constitutes the first face 2*a* of the element body 2. The first external electrode 3 and the second external electrode 4 are arranged on the insulating layer 14. An aperture 14*a* is formed corresponding to the position where the first external electrode 3 is arranged, in the insulating layer 14 so as to penetrate the insulating layer 14 from the first face 2*a* to the face in contact with the varistor element body 11. The first external electrode 3 passes through the aperture 14*a* to reach the face 11*a* of the varistor element body 11 and is physically and electrically connected to the through-hole electrode 16 exposed in the face 11*a*. The first external electrode 3 and the first varistor electrode 12 are electrically connected to each other through the through-hole electrode 16.

An aperture 14*b* is formed corresponding to the position where the first external electrode 3 is arranged, in the insulating layer 14 so as to penetrate the insulating layer 14 from the first face 2*a* to the face in contact with the varistor element body 11. The second external electrode 4 passes through the aperture 14*b* to reach the face 11*a* of the varistor element body 11 and is physically and electrically connected to the through-hole electrode 17 exposed in the face 11*a*. The second external electrode 4 and the second varistor electrode 13 are electrically connected to each other through the through-hole electrode 17. The insulating layer 14 is made of an electrically insulating material (e.g., polyimide resin).

The insulating layer 15 is in contact with the face 11*b* of the varistor element body 11 and constitutes the third face 10*a* of the varistor section 10. The insulating layer 15 is in contact with the heat radiation section 20. Through-hole electrodes 18, 19 are formed in the insulating layer 15 so as to penetrate the insulating layer 15 in its thickness direction (the aforementioned facing direction). The through-hole electrode 18 is physically and electrically connected at one end to the through-hole electrode 16 penetrating the varistor element body 11 and the other end of the through-hole electrode 18 is exposed in the third face 10*a*. The through-hole electrode 19 is physically and electrically connected at one end to the through-hole electrode 17 penetrating the varistor element body 11 and the other end of the through-hole electrode 19 is exposed in the third face 10*a*. The insulating layer 15 is made of a material containing ZnO as a major component and a glass component of a zinc borosilicate type as an additive. When the insulating layer 15 is made of such a material, the element body 2 including the insulating layer 15 can be obtained by simultaneous firing.

The heat radiation section 20 is of a nearly rectangular parallelepiped shape. The four side faces of the heat radiation section 20 constitute some areas of the four side faces 2*c*-2*f* of the element body 2, i.e., portions of the four side faces 2*c*-2*f* near the second face 2*b*. The heat radiation section 20 has first and second heat radiation portions 21, 22 of a nearly rectangular parallelepiped shape, and an insulating layer 23 for electrically insulating the first heat radiation portion 21 and the second heat radiation portion 22 from each other.

The first heat radiation portion 21 and the second heat radiation portion 22 are arranged in juxtaposition in a direction in which the side face 2*c* and the side face 2*d* of the element body 2 face each other, the first heat radiation portion 21 is located nearer to the side face 2*c*, and the second heat radiation portion 22 is located nearer to the side face 2*d*. The face 21*a* of the first heat radiation portion 21 is in contact with the insulating layer 15 and the first heat radiation portion 21 is physically and electrically connected to the through-hole electrode 18. A face 21*b* facing the face 21*a* of the first heat radiation portion 21 constitutes a part of the second face 2*b* of the element body 2, or a portion of the second face 2*b* nearer to the side face 2*c*. The third external electrode 5 is arranged on the face 21*b* of the heat radiation portion 21 and the first heat radiation portion 21 is physically and electrically connected to the third external electrode 5. The first external electrode 3 and the third external electrode 5 are thus electrically connected to each other through the first heat radiation portion 21, through-hole electrodes 16, 18, and first varistor electrode 12.

A face 22*a* of the second heat radiation portion 22 is in contact with the insulating layer 15 and the second heat radiation portion 22 is physically and electrically connected to the through-hole electrode 19. A face 22*b* facing the face 22*a* of the second heat radiation portion 22 constitutes a part of the second face 2*b* of the element body 2, or a portion of the second face 2*b* nearer to the side face 2*d*. The fourth external electrode 6 is arranged on the face 22*b* of the second heat radiation portion 22 and the second heat radiation portion 22 is physically and electrically connected to the fourth external electrode 6. The second external electrode 4 and the fourth external electrode 6 are electrically connected to each other through the second heat radiation portion 22, through-hole electrodes 17, 19, and second varistor electrode 13.

The first heat radiation portion 21 and the second heat radiation portion 22 are made of a composite material of a metal and a metal oxide. The metal can be, for example, Ag, Ag—Pd, Pd, or the like and is preferably Ag with good thermal conductivity. The metal oxide can be, for example, $Al_2O_3$, ZnO, $SiO_2$, $ZrO_2$, or the like. An example of the composite material is particles of $Al_2O_3$ coated, for example, with an Ag coating by electroless plating. This allows the first heat radiation portion 21 and the second heat radiation portion 22 to have the electric conduction function and the thermal radiation function.

The insulating layer 23 to electrically insulate the first heat radiation portion 21 and the second heat radiation portion 22 from each other is arranged between the first heat radiation portion 21 and the second heat radiation portion 22. The insulating layer 23 is in contact with a side face of the first heat radiation portion 21 and with a side face of the second heat radiation portion 22. The insulating layer 23 is made of a material containing ZnO as a major component and a glass component of a zinc borosilicate type as an additive. When the insulating layer 23 is made of such a material, the element body 2 including the insulating layer 23 can be manufactured by simultaneous firing.

The varistor V is connected to an electronic device such as a semiconductor light-emitting device or FET with the first and second external electrodes 3, 4 being connected in parallel thereto, so as to protect the electronic device from ESD. The third and fourth external electrodes 5, 6 are connected to lands on a substrate whereby the varistor is mounted on the substrate by flip chip mounting.

A production process of varistor V will be described below. The production process of varistor V involves producing an aggregate substrate and cutting the aggregate substrate to obtain a plurality of varistors V. For producing the aggregate substrate, a predetermined number of varistor green sheets to form the varistor element body 11 are prepared. First, a varistor composition powder is prepared by mixing ZnO as a major component of the varistor element body 11 and metals or oxides of Pr, Co, Cr, Ca, Si, and so on as minor components at a predetermined ratio. Then, an organic binder, an organic solvent, an organic plasticizer, etc. are added into the varistor composition powder to obtain a slurry. The slurry thus obtained is applied onto film and dried to obtain varistor green sheets.

Next, a plurality of internal electrode patterns are formed in an array on two varistor green sheets. Each internal electrode pattern formed on one of the two varistor green sheets will become the first varistor electrode 12 and each internal electrode pattern formed on the other green sheet will become the second varistor electrode 13. The internal electrode patterns are formed by preparing an electroconductive paste as a mixture of a metal powder consisting primarily of Ag particles, with an organic binder and an organic solvent, printing the electroconductive paste onto the varistor green sheets, and drying it.

Next, an organic binder, an organic solvent, an organic plasticizer, etc. are added into an insulating material to obtain a slurry to form the insulating layer 15. The resulting slurry is applied onto film and dried to obtain an insulating green sheet.

Next, a plurality of heat radiation green sheets to form the heat radiation section 20 are prepared. First, Ag powder is mixed in the varistor composition powder to form the varistor element body 11, and an organic binder, an organic solvent, an organic plasticizer, etc. are added into the resultant mixture to obtain a slurry to form the first and second heat radiation portions 21, 22. Then, an organic binder, an organic solvent, an organic plasticizer, etc. are mixed into an insulating material to obtain a slurry to form the insulating layer 23.

The slurry for the first and second heat radiation portions 21, 22 is applied onto film so as to form spaces for portions of insulating layer 23, and then dried. Thereafter, the slurry for insulating layer 23 is printed in the space portions to obtain the heat radiation green sheets.

The varistor green sheets without any print, varistor green sheets with the internal electrode patterns printed, insulating green sheet, and heat radiation green sheets, which were obtained as described above, are laminated in a predetermined order and pressed to obtain a green laminate body. Through holes are preliminarily formed at positions corresponding to the through-hole electrodes 16-19 in the varistor green sheets and the insulating green sheets and filled with a conductor paste.

Next, the green laminate body thus obtained is subjected to debindering. For example, the debindering is carried out by heating the green laminate body at the temperature of 180° C.-400° C. for about 0.5-24 hours. After the debindering of the green laminate body, it is fired at the temperature of 800° C. or higher in an $O_2$ atmosphere to obtain the aggregate substrate.

A polyimide layer to become the insulating layer 14 is formed on one face of the resulting aggregate substrate and this polyimide layer is perforated to form openings for the apertures 14*a*, 14*b*. Then the first and second external electrodes 3, 4 are formed so as to close the apertures 14*a*, 14*b*. The third and fourth external electrodes 5, 6 are formed on the other face of the aggregate substrate. Thereafter, the aggregate substrate is cut into individual varistors V The varistors V are completed through the above steps.

In the varistor V of the present embodiment as described above, the first and second external electrodes 3, 4 are arranged on the first face 2*a* of the element body 2, the third and fourth external electrodes 5, 6 are arranged on the second face 2*b*, the first heat radiation portion 21 in contact with the varistor section 10 electrically connects the first external electrode 3 and the third external electrode 5, and the second heat radiation portion 22 in contact with the varistor section 10 electrically connects the second external electrode 4 and the fourth external electrode 6. This permits the varistor V to be mounted on a substrate by flip chip mounting in such a manner that the first and second external electrodes 3, 4 arranged on the first face 2*a* are connected to an external device and that the third and fourth external electrodes 5, 6 arranged on the second face 2*b* are connected to lands on the substrate. The first heat radiation portion 21 and the second heat radiation portion 22 efficiently radiate heat of the external device. Since the first heat radiation portion 21 has the two functions, the function to electrically connect the first external electrode 3 and the third external electrode 5 and the heat radiation function, and the second heat radiation portion 22 has the two functions, the function to electrically connect the second external electrode 4 and the fourth external electrode 6 and the heat radiation function, as described above, it becomes feasible to relatively simplify the configuration of the varistor V and to facilitate the production of the varistor V.

The varistor V of the present embodiment can be modified in various ways. First to fourth modification examples will be described below.

First Modification Example

Figure 3:
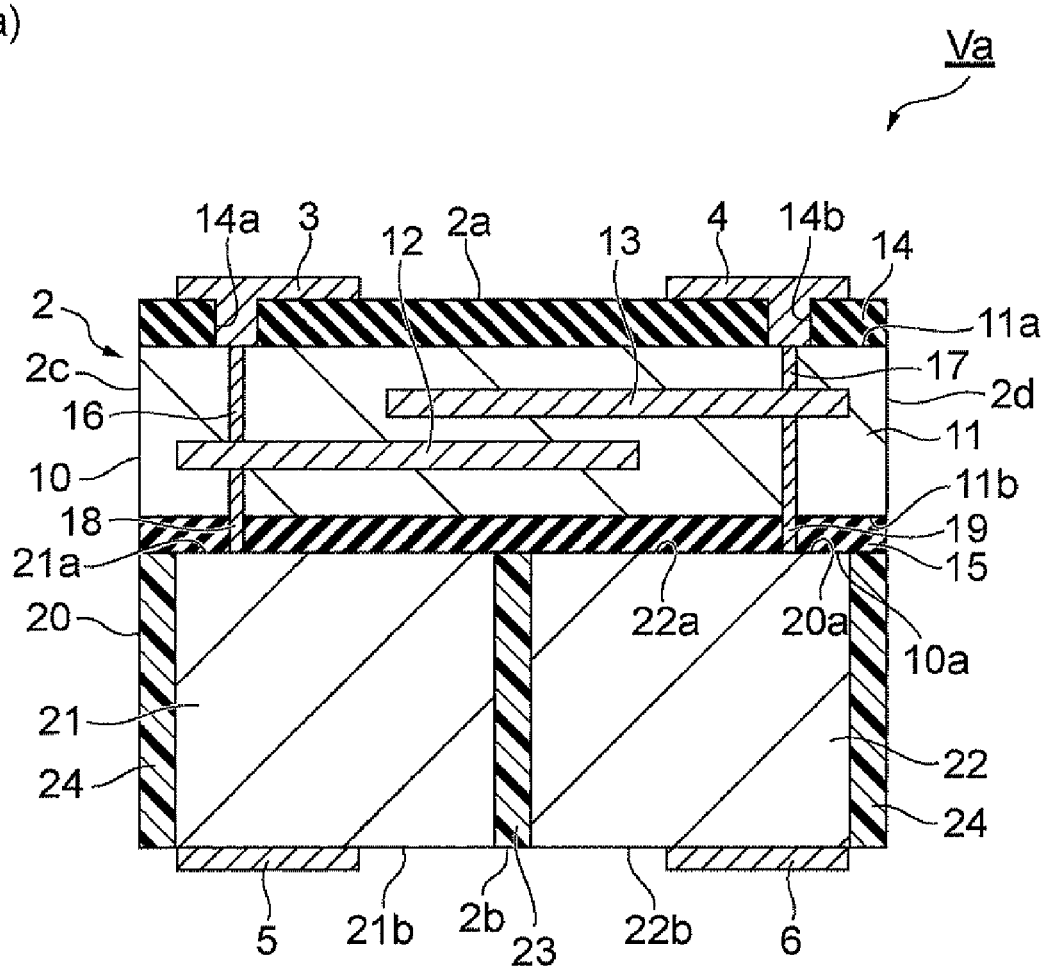
FIG. 3 is schematic views showing a varistor according to a first modification example of the embodiment.
Figure 3:
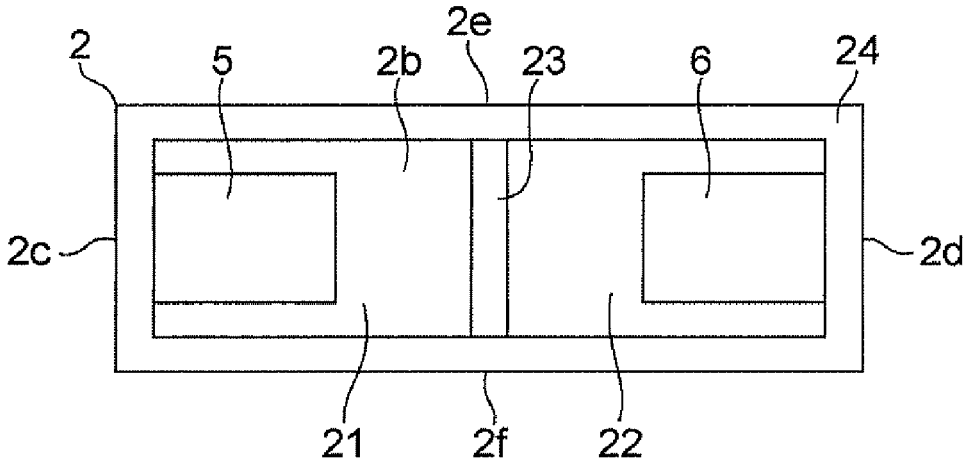

In the foregoing embodiment the side faces of the first and second heat radiation portions 21, 22 are exposed, but they may be covered by an insulator, as shown in FIG. 3. FIG. 3(*a*) is a schematic sectional view of the varistor according to the first modification example and FIG. 3(*b*) a plan view from the side of the second face 2*b* of the element body 2. The varistor Va of the first modification example is so configured that the heat radiation section 20 further has an insulating layer 24 to cover the side faces of the first and second heat radiation portions 21, 22.

The insulating layer 24 constitutes some areas of the side faces 2*c*-2*f* of the element body 2 in the heat radiation section 20. In this case, electrical insulation from surrounding parts is certainly achieved in a mounted state of the varistor of the present invention.

For producing the varistor Va of the first modification example, the heat radiation green sheets are formed by applying the slurry for the first and second heat radiation portions 21, 22 onto film so as to form spaces for the portions of the insulating layer 23 and the insulating layer 24 and drying it. Then the slurry for the insulating layers 23, 24 is printed in the space portions to obtain the heat radiation green sheets. The green laminate body is then obtained by laminating the heat radiation green sheets, varistor green sheets without any print, varistor green sheets with the internal electrode patterns printed, and insulating green sheet in the predetermined order.

The resulting green laminate body is subjected to debindering and firing to form the aggregate substrate. When the aggregate substrate is cut into individual varistors Va, it is cut through the portions to become the insulating layer 24. The cutting work is easier in cutting the material forming the insulating layer 24 than in cutting the material forming the first and second heat radiation portions 21, 22. Therefore, the varistor Va can be readily produced by cutting the aggregate substrate through the portions to become the insulating layer 24.

Second Modification Example

The foregoing embodiment is the example wherein the first and second external electrodes 3, 4 are connected to the electronic device and wherein the third and fourth external electrodes 5, 6 are connected to the substrate, but it can also be contemplated that the third and fourth external electrodes 5, 6 are connected to the electronic device and the first and second external electrodes 3, 4 are connected to the substrate.

Figure 4:
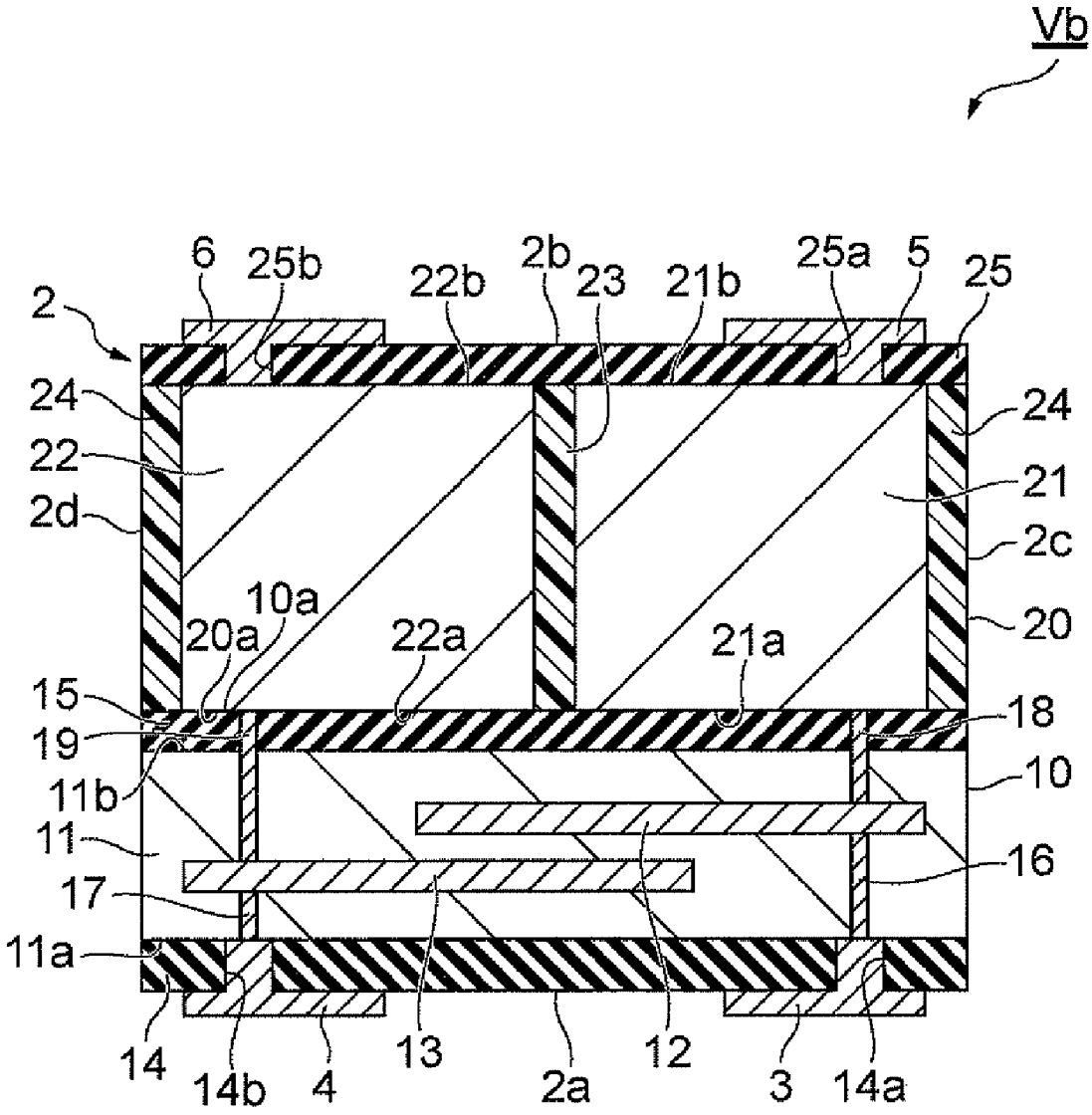
FIG. 4 is a schematic sectional view showing a varistor according to a second modification example of the embodiment.

As shown in FIG. 4, the varistor Vb of the second modification example is preferably provided with an insulating layer 25 to cover the face of the first and second heat radiation portions facing the electronic device. The insulating layer 25 constitutes the second face 2*b* of the element body 2. Apertures 25*a*, 25*b* penetrating the insulating layer 25 in the thickness direction are formed in the insulating layer 25 and the third and fourth external electrodes 5, 6 are arranged so as to cover the apertures 25*a*, 25*b*, respectively. This makes the third external electrode 5 physically and electrically connected to the first heat radiation portion 21 and makes the fourth external electrode 6 physically and electrically connected to the second heat radiation portion 22.

In this configuration wherein the third and fourth external electrodes 5, 6 are connected to the electronic device and wherein the first and second external electrodes 3, 4 are connected to the substrate, the heat radiation section 20 and the electronic device become closer to each other and thus heat of the electronic device is more efficiently radiated.

Third Modification Example

Figure 5:
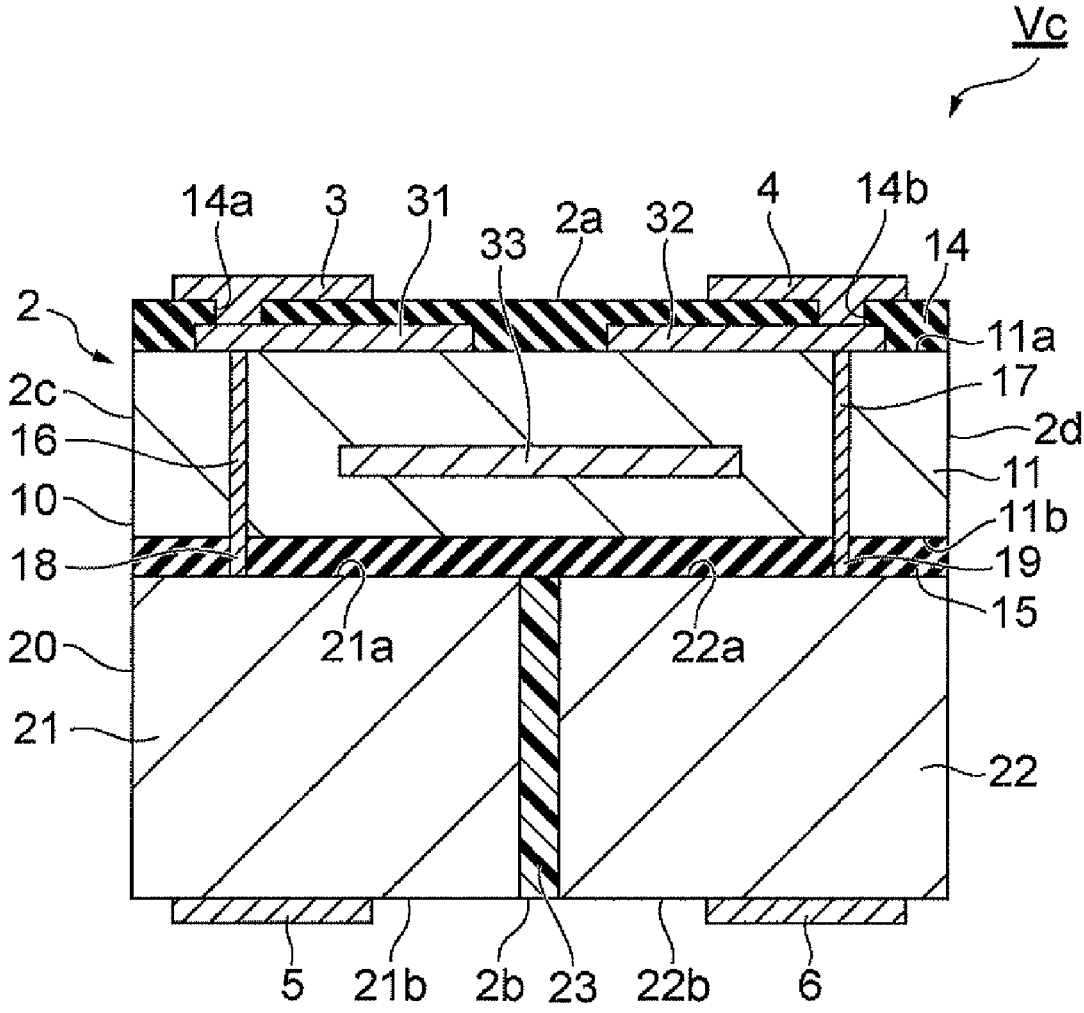
FIG. 5 is a schematic sectional view showing a varistor according to a third modification example of the embodiment.

In the foregoing embodiment the first varistor electrode 12 and the second varistor electrode 13 are arranged so as to face each other in the varistor element body 11, but the configuration of the varistor electrodes does not always have to be limited to it. As shown in FIG. 5, the varistor Vc of the third modification example is provided with first to third varistor electrodes 31-33, instead of the first and second varistor electrodes of the varistor V of the above embodiment. The first and second varistor electrodes 31, 32 are arranged in a mutually insulated state on the face 11*a* of the varistor element body 11. The third varistor electrode 33 is arranged inside the varistor element body 11 so as to face the first and second varistor electrodes 31, 32.

The first varistor electrode 31 is physically and electrically connected to one end of the through-hole electrode 16 exposed in the face 11*a* of the varistor element body 11 and the second varistor electrode 32 is physically and electrically connected to one end of the through-hole electrode 17 exposed in the face 11*a* of the varistor element body 11. The first and second varistor electrodes 31, 32 are covered by the insulating layer 14. The first varistor electrode 31 is physically and electrically connected to the first external electrode 3 through the aperture 14*a* formed in the insulating layer 14, and the second varistor electrode 32 is physically and electrically connected to the second external electrode 4 through the aperture 14*b* formed in the insulating layer 14.

Fourth Modification Example

Figure 6:
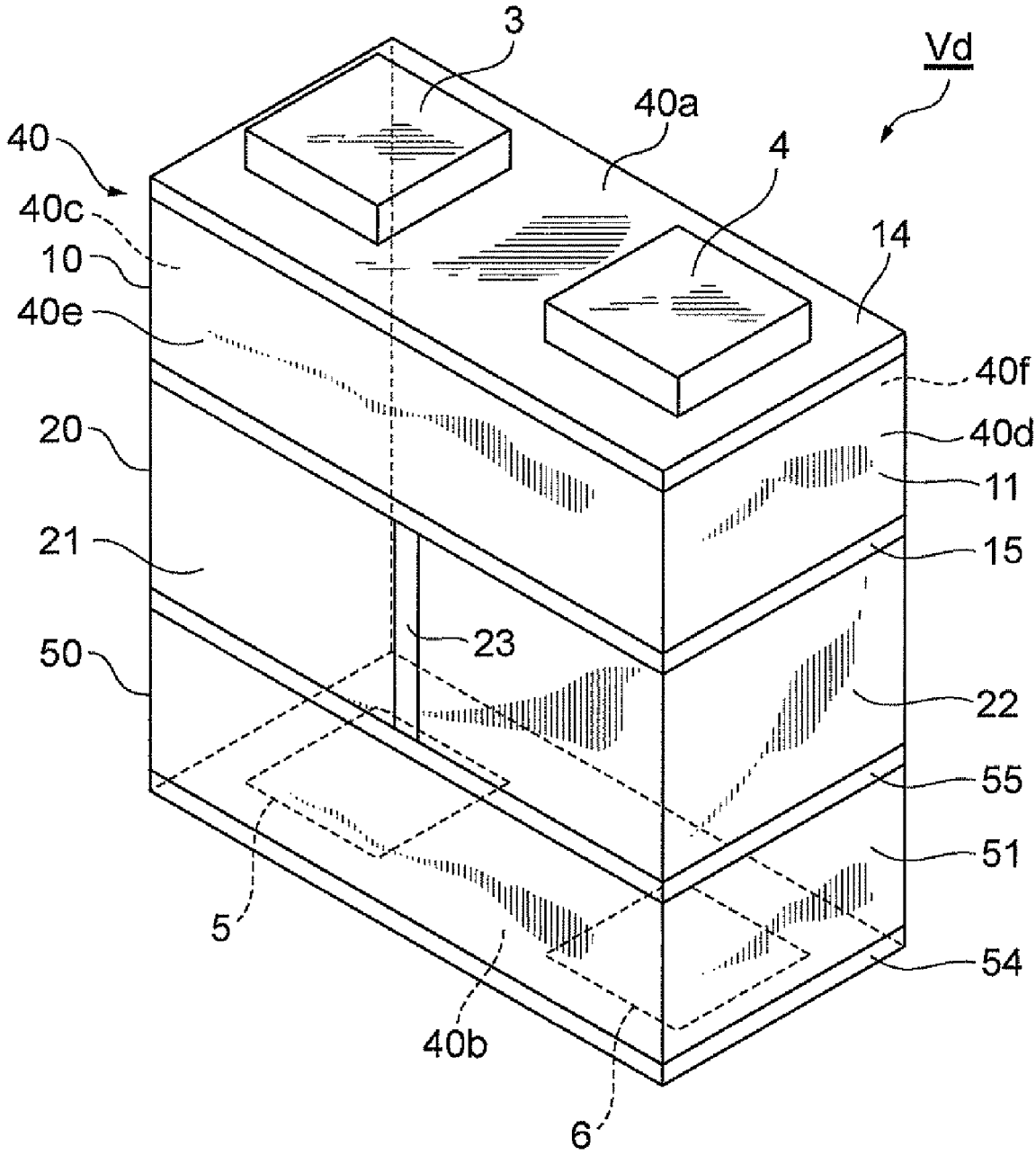
FIG. 6 is a schematic perspective view showing a varistor according to a fourth modification example of the embodiment.
Figure 7:
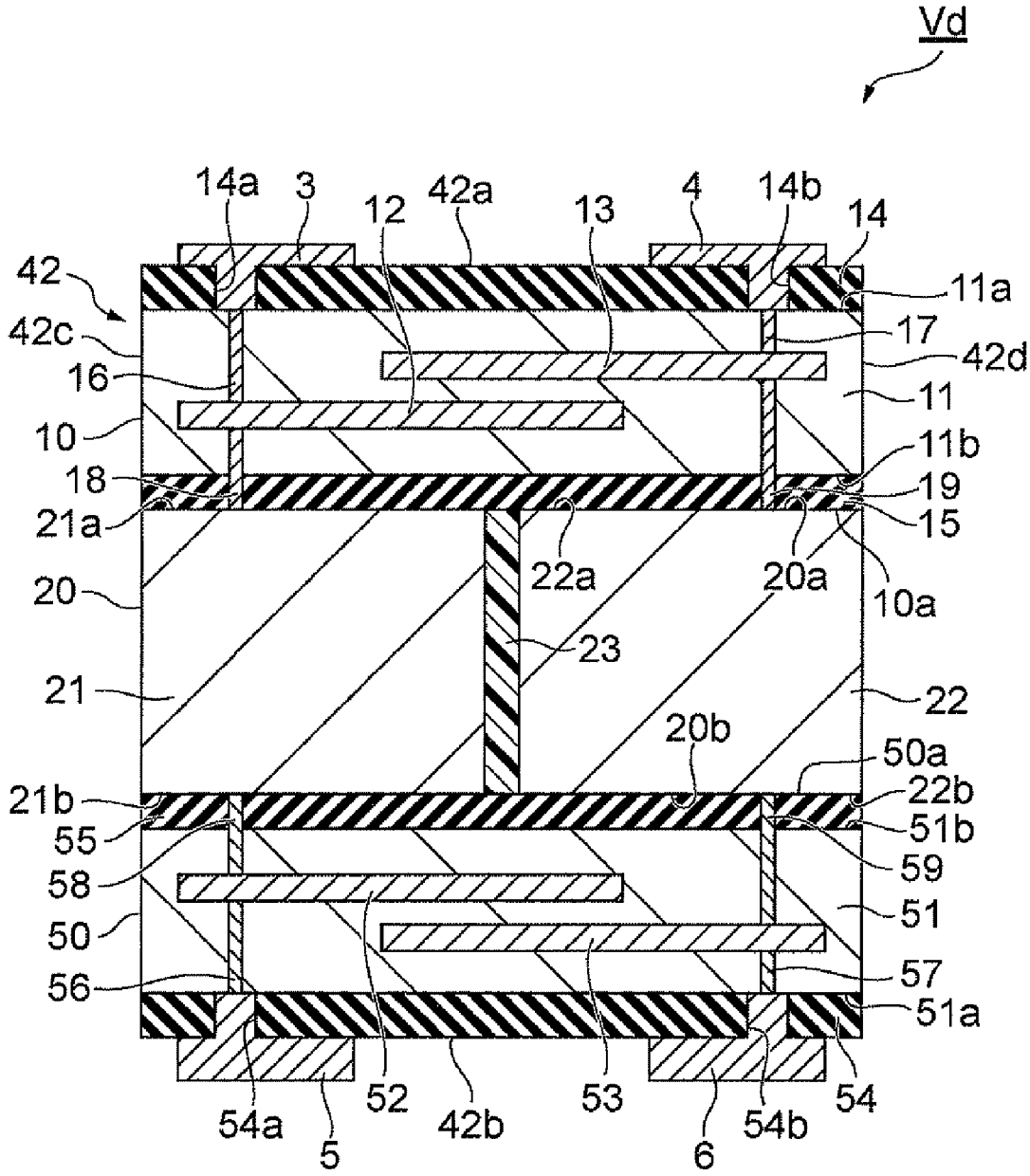
FIG. 7 is a schematic sectional view showing the varistor according to the fourth modification example of the embodiment.

As shown in FIGS. 6 and 7, the varistor may be provided with another varistor section, in addition to the varistor section 10. The varistor Vd of the fourth modification example is provided with an element body 42. The element body 42 has a varistor section 10, a heat radiation section 20, and a varistor section 50. The varistor section 50 is arranged in symmetry with the varistor section 10 with respect to the heat radiation section 20. Namely, the heat radiation section 20 is sandwiched between the varistor section 10 and the varistor section 50.

The element body 42 has a first face 42*a* and a second face 42*b* facing each other, and four side faces 42*c*-42*f* perpendicular to the first and second faces 42*a*, 42*b*. The first and second external electrodes 3, 4 are arranged on the first face 42*a* of the element body 42 and the third and fourth external electrodes 5, 6 are arranged on the second face 42*b* of the element body 42.

The element body 42 has the varistor section 10 located on the first face 42*a* side, the varistor section 50 located on the second face 42*b* side, and the heat radiation section 20 located between the varistor section 10 and the varistor section 50. The varistor section 10 is of a nearly rectangular parallelepiped shape and includes the first face 42*a*, and the third face 10*a* facing the first face 42*a*. The varistor section 50 is of a nearly rectangular parallelepiped shape and includes the second face 42*b*, and a fourth face 50*a* facing the second face 42*b*. The heat radiation section 20 is of a nearly rectangular parallelepiped shape and includes a face 20*a* and a face 20*b* facing each other. The third face 10*a* of the varistor 10 is in contact with the face 20*a* of the heat radiation section 20 and the fourth face 50*a* of the varistor section 50 is in contact with the face 20*b* of the heat radiation section 20.

The varistor section 50 has a varistor element body 51 of a nearly rectangular parallelepiped shape, a first varistor electrode 52 and a second varistor electrode 53 arranged inside the varistor element body 51, and two insulating layers 54, 55 to sandwich the varistor element body 51 in the facing direction.

The varistor element body 51 includes a face 51*a* and a face 51*b*. The face 51*a* and the face 51*b* face each other in the foregoing facing direction and are in contact with the insulating layers 54, 55, respectively. The four side faces of the varistor element body 51 constitute certain areas of the four side faces 42*c*-42*f* of the element body 42, i.e., portions of the four side faces 42*c*-42*f* near the second face 42*b*. The varistor element body 51 is made of a material to exhibit the nonlinear voltage-current characteristics and, specifically, it contains ZnO as a major component and Pr, Bi, etc. as minor components. These minor components exist in the form of simple metal or oxide in the varistor element body.

The first varistor electrode 52 and the second varistor electrode 53 are formed in a nearly rectangular shape and are arranged so as to face each other in the facing direction as electrically insulated from each other. The first varistor electrode 52 is arranged nearer to the side face 42*c* and to the fourth face 50*a* than the second varistor electrode 53.

The varistor section 50 has a through-hole electrode 56 and a through-hole electrode 57. The through-hole electrode 56 is physically and electrically connected to the first varistor electrode 52 and penetrates the varistor element body 51 between the face 51*a* and the face 51*b* thereof. The through-hole electrode 57 is physically and electrically connected to the second varistor electrode 53 and penetrates the varistor element body 51 between the face 51*a* and the face 51*b* thereof. One end of each through-hole electrode 56, 57 is exposed in the face 51*a* and the other end is exposed in the face 51*b*.

The insulating layer 54 is in contact with the face 51*a* of the varistor element body 51 and constitutes the second face 42*b* of the element body 42. The third external electrode 5 and the fourth external electrode 6 are arranged on the insulating layer 54. An aperture 54*a* is formed corresponding to the position where the third external electrode 5 is arranged, in the insulating layer 54 so as to penetrate the insulating layer 54 from the second face 42*b* to the face in contact with the varistor element body 51. The third external electrode 5 passes through the aperture 54*a* to reach the face 51*a* of the varistor element body 51 and is physically and electrically connected to the through-hole electrode 56 exposed in the face 51*a*. The third external electrode 5 and the first varistor electrode 52 are electrically connected to each other through the through-hole electrode 56.

An aperture 54*b* is formed corresponding to the position where the fourth external electrode 6 is arranged, in the insulating layer 54 so as to penetrate the insulating layer 54 from the second face 42*b* to the face in contact with the varistor element body 51. The fourth external electrode 6 passes through the aperture 54*b* to reach the face 51*a* of the varistor element body 51 and is physically and electrically connected to the through-hole electrode 57 exposed in the face 51*a*. The fourth external electrode 6 and the second varistor electrode 53 are electrically connected to each other through the through-hole electrode 57. The insulating layer 54 is made of a material such as polyimide resin.

The insulating layer 55 is in contact with the face 51*b* of the varistor element body 51 and constitutes the third face 50*a* of the varistor section 50. The insulating layer 55 is in contact with the heat radiation section 20. Through-hole electrodes 58, 59 are formed in the insulating layer 55 so as to penetrate the insulating layer 55 in its thickness direction (the aforementioned facing direction). The through-hole electrode 58 is physically and electrically connected at one end to the through-hole electrode 56 penetrating the varistor element body 51 and the other end of the through-hole electrode 58 is exposed in the fourth face 50*a*. The through-hole electrode 59 is physically and electrically connected at one end to the through-hole electrode 57 penetrating the varistor element body 51 and the other end of the through-hole electrode 59 is exposed in the fourth face 50*a*. The insulating layer 55 is made of a material containing ZnO as a major component and a glass component of a zinc borosilicate type as an additive. When the insulating layer 55 is made of such a material, the element body 42 including the insulating layer 55 can be obtained by simultaneous firing.

The varistor element body 51, first varistor electrode 52, second varistor electrode 53, insulating layers 54, 55, and through-hole electrodes 56-59 as described above are arranged in symmetry with the varistor element body 11, first varistor electrode 12, second varistor electrode 13, insulating layers 14, 15, and through-hole electrodes 16-19, respectively, with respect to the heat radiation section 20. The first external electrode 3 and the third external electrode 5 are electrically connected to each other through the through-hole electrodes 16, 18, 56, 58, first varistor electrodes 12, 52, and first heat radiation portion 21. The second external electrode 4 and the fourth external electrode 6 are electrically connected to each other through the through-hole electrodes 17, 19, 57, 59, second varistor electrodes 13, 53, and second heat radiation portion 22.

The varistor Vd of the present modification example described above is also configured as follows: the first and second external electrodes 3, 4 are arranged on the first face 42*a* of the element body 42; the third and fourth external electrodes 5, 6 are arranged on the second face 42*b*; the first heat radiation portion 21 in contact with the varistor sections 10, 50 electrically connects the first external electrode 3 and the third external electrode 5; the second heat radiation portion 22 in contact with the varistor sections 10, 50 electrically connects the second external electrode 4 and the fourth external electrode 6. This permits the varistor Vd to be mounted on a substrate by flip chip mounting in such a manner that the first and second external electrodes 3, 4 arranged on the first face 42*a* of the element body 42 are connected to an external device and that the third and fourth external electrodes 5, 6 arranged on the second face 42*b* are connected to lands on the substrate. The first heat radiation portion 21 and the second heat radiation portion 22 efficiently radiate heat of the external device. Since the first heat radiation portion 21 has the two functions, the function to electrically connect the first external electrode 3 and the third external electrode 5 and the heat radiation function, and the second heat radiation portion 22 has the two functions, the function to electrically connect the second external electrode 4 and the fourth external electrode 6 and the heat radiation function, as described above, it becomes feasible to relatively simplify the configuration of the varistor Vd and to facilitate the production of the varistor Vd.

Since the varistor Vd of the present modification example has the two varistor sections, the two varistor sections 10, 50 can be connected in parallel by connecting the electronic device to the first and second external electrodes 3, 4.

Since the varistor Vd of the present modification example has the symmetrical configuration with respect to the heat radiation section 20, there is no distinction between top and bottom and it is thus easy to handle it during mounting.

The varistor of the present invention described above is not limited only to the above-described embodiment and modification examples, but can also be further modified. For example, the major component of the varistor element body 11, 51 was ZnO in the above embodiment, but it may be $SrTiO_3$, $BaTiO_3$, SiC, or the like.

The varistors V and Va-Vd had the insulating layer 15, but the insulating layer 15 is not always necessary. In a configuration wherein the varistor V, Va-Vd is not provided with the insulating layer 15, where the varistor element body 11 and the first and second heat radiation portions 21, 22 are made of a material containing a metal oxide, cracking is prevented from occurring between the varistor element body 11 and the heat radiation section 20 during firing and the joint strength between them is ensured.

The electronic device to be connected to the varistor V, Va-Vd may be an LED of a nitride type semiconductor except for GaN, e.g., InGaNAs type semiconductor LED, or may be a semiconductor LED other than the nitride type, or an LD. Without having to be limited to the LEDs, a variety of electronic devices that generate heat during operation, e.g., a field effect transistor (FET) or a bipolar transistor may be connected to the varistor V, Va-Vd.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A varistor comprising:

an element body having a first face and a second face facing each other;

first and second external electrodes arranged on the first face of the element body; and third and fourth external electrodes arranged on the second face of the element body, wherein the element body has:

a first varistor section including the first face, and a third face facing the first face; and a heat radiation section in contact with the third face of the first varistor section, wherein the first varistor section has:

a first varistor element body to exhibit the nonlinear voltage-current characteristics;

a first varistor electrode at least a part of which is in contact with the first varistor element body and which is electrically connected to the first external electrode; and a second varistor electrode at least a part of which is in contact with the first varistor element body and which is electrically connected to the second external electrode, and wherein the heat radiation section has:

a first heat radiation portion in contact with the third face of the first varistor section, said first heat radiation portion containing a metal and electrically connected to the first and third external electrodes;

a second heat radiation portion in contact with the third face of the first varistor section, said second heat radiation portion containing a metal and electrically connected to the second and fourth external electrodes; and an insulating layer located between the first heat radiation portion and the second heat radiation portion and electrically insulating the first heat radiation portion and the second heat radiation portion from each other.

2. The varistor according to claim 1, wherein the element body further has a second varistor section including the second face, and a fourth face facing the second face, wherein in each of the first and second heat radiation portions, a face facing a face in contact with the third face of the first varistor section is in contact with the fourth face of the second varistor section, and wherein the second varistor section has:

a second varistor element body to exhibit the nonlinear voltage-current characteristics;

a third varistor electrode at least a part of which is in contact with the second varistor element body and which is electrically connected to the third external electrode; and a fourth varistor electrode at least a part of which is in contact with the second varistor element body and which is electrically connected to the fourth external electrode.

3. The varistor according to claim 1, wherein in the first heat radiation portion a face facing a face in contact with the third face of the first varistor section comprises the second face and is physically and electrically connected to the third external electrode, and wherein in the second heat radiation portion a face facing a face in contact with the third face of the first varistor section comprises the second face and is physically and electrically connected to the fourth external electrode.

4. The varistor according to claim 1, wherein the heat radiation section further includes a side face parallel to a direction in which the first face and the second face face each other, and wherein the side face is covered by an insulator.

5. The varistor according to claim 1, wherein the first varistor element body contains ZnO as a major component, and wherein the first and second heat radiation portions are comprised of a composite material of a metal and a metal oxide.

6. The varistor according to claim 1, wherein the insulating layer of the heat radiation section is made of a ceramic material.

7. The varistor according to claim 2, wherein the first and second varistor element bodies contain ZnO as a major component, and wherein the first and second heat radiation portions are comprised of a composite material of a metal and a metal oxide.

* * * * *